United States Patent [19]

Douglass

[11] 4,150,514

[45] Apr. 24, 1979

[54] PROCESS FOR MOLDING BONDED REFRACTORY PARTICLES

[75] Inventor: Thomas E. Douglass, Woodbridge, Conn.

[73] Assignee: Ferro Corporation, Cleveland, Ohio

[21] Appl. No.: 846,379

[22] Filed: Oct. 28, 1977

[51] Int. Cl.[2] ..... B24D 11/00; C09K 3/14

[52] U.S. Cl. ..... 51/298; 51/293; 51/307; 264/25

[58] Field of Search ..... 51/295, 298, 307, 293, 51/299; 264/23, 25, 27

[56] References Cited

U.S. PATENT DOCUMENTS

| | | | |
|---|---|---|---|
| 1,968,799 | 7/1934 | Elbel | 51/298 |
| 1,993,821 | 3/1935 | Benner | 51/298 |
| 2,469,398 | 5/1949 | Meyer | 51/298 |
| 3,116,986 | 1/1964 | Goepfert et al. | 51/298 |

*Primary Examiner*—Donald J. Arnold

*Attorney, Agent, or Firm*—Milton L. Simmons; Wesley B. Taylor

[57] ABSTRACT

A process is disclosed for molding a mixture of refractory particles, and especially abrasive refractory particles, and an organic resinous binder into an integral body. The mixture is preheated, preferably by microwave energy, in the absence of pressure on the mixture to a temperature elevated with respect to room temperature to insure the binder is fluid but below a temperature at which degradation or decomposition of the binder takes place. The mixture is then compacted by pressure, preferably at the preheating temperature, until a density is reached substantially equal to that desired in the finally molded integral body while still maintaining the binder in a fluid state. The resinous binder is then converted to a solid state to bind the particles one to another while still maintaining the compaction pressure on the mixture. In a preferred practice, the process is adapted as well to increase the rate of production of a press by preheating multiple charges of the mixture apart from the press and then simultaneously compacting all of the charges in the press followed by conversion of the resinous binder to a solid state.

14 Claims, 7 Drawing Figures

PROCESS FOR MOLDING BONDED REFRACTORY PARTICLES

BACKGROUND OF THE INVENTION

Products of bonded refractory particles are commonly made by a press in which a charge of a mixture of the particles and a resinous binder and usually known fillers is compacted into a desired shape between ram-actuated mating mold parts of a press. The press action is usually attended by heat, such as steam heating of the molds, in order to set or harden the binder which for this reason must be thermosetting. U.S. Pat. No. 3,268,632 to Eves illustrates a press of this general type for molding grinding wheels assemblies.

With molding systems presently in use, there are several disadvantages, both economically and in the quality of the products or bodies molded. In the usual process, a charge of the mixture of refractory particles and binder must be heated uniformly throughout the charge to insure fluidity of the binder. Compaction of the charge beings early in the heating stage, but completion of the compaction, when maximum density is obtained, must be postponed until the charge is well heated and the fluidized binder has wetted well the refractory particles. Since on a time basis, the heating step consumes a substantial portion of the press cycle, the result is that relatively expensive press equipment is used primarily only for heating. Consequently, the rate of production of the press is seriously hampered.

The practice of compacting or compressing a charge of particles and binder while the charge is being heated, first to fluidize the resin and then to set or harden it, culminating eventually in a maximum compression has been found actually to introduce fine cracks and fractures along the outer surfaces of the product or body molded. These defects weaken the strength of the molded product and also shorten its useful life.

SUMMARY OF THE INVENTION

In the present process, the press cycle is shortened by preheating a charge of the particle-resin mixture apart from the press to within a predetermined temperature range which insures the binder is fluidized and then introducing the charge to the press. Preferably, the preheating is accomplished by subjecting the charge to microwave energy which quickly effects the preheating and further reduces the overall time required to mold an integral body. In one form, multiple charges of the mixture are preheated and placed at one time in segregated fashion within a press. Accordingly, the press equipment is used substantially only for compacting the mixture and setting of the binder and can be so operated at a greater frequency than when the press is used as a heating unit as well for the charge.

As a further significant aspect of the present process, molded integral bodies of greater strength and prolonged useful life are obtained by delaying compaction of the refractory particle-resin binder mixture, until the binder has been thoroughly fluidized and distributed throughout the mixture to wet thoroughly the particles; and, further, by delaying setting or conversion of the resinous binder to a solid state to bind the particles one to another until after a predetermined maximum compaction of the mixture is obtained, and then so setting the binder while maintaining the maximum compaction. Such maximum compaction generally will correspond to a density substantially equal to the density desired in the ultimately molded body.

As a rule, the particle-binder mixture is placed in a mold form, such as that for a grinding wheel, and it is while in the mold form that the mixture is subjected to preheating, compaction and binder setting as described. Normally, the molded body is stripped from the mold form and undergoes a post cure heating step.

DESCRIPTION OF THE PREFERRED EMBODIMENTS

Figure 1:
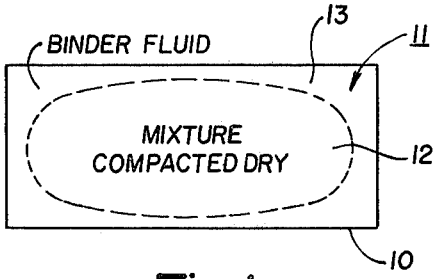
FIGS. 1 through 4 are diagramatic, schematic illustrations of sequential steps in the preparation of a refractory body by prior processes.

In order to further an appreciation of the present process, a general prior art process is initially described and then the improvements afforded by the present process are disclosed, both with reference to the figures. To facilitate description of the process, it is then described in detail with respect to molding an abrasive grinding wheel, although the process is adapted for broader applications in which other bodies of bonded refractory particles are prepared.

It has been the practice in molding refractory particles, such as abrasive refractory particles, with particles of a thermosetting organic resinous binder to charge a mold form with a mixture of particles of the refractory material and the binder. The binder particles are substantially solid and dry but in an early stage of polymerization capable of further polymeric growth or cross-linking. For example, in molding a grinding wheel, a mold form is used having a cavity of circular configuration and a central, circular opening. Such a form may comprise two concentric steel bands resting on a bottom plate. A top plate over the bands may or may not be used, but if it is used, the top plate is designed to fit and pass between the bands during compaction or compression of the particle mixture.

In practice, a mixture of the refractory-binder particles fills the mold form and the form and its charge are placed between the platens of a heated press in which the charge is simultaneously compacted and heated as the platens move relatively toward each other. The heat of the molding operation first fluidizes the particles of the thermosetting binder and then completes their cure and hardens them while adhering the refractory particles into an integral mass. The refractory body so molded is removed from the mold form and usually subjected to a post cure.

This type of process has been found to introduce relatively fine cracks, fractures or fissures on the surface of the molded body which weaken its inherent strength and shorten its useful life. It is believed that the simultaneous compaction and heating of the particle mixture are responsible for the creation of the fine cracks due to the formation of differing, generally concentric areas within the charge of the mixture which at one and the same time may comprise a dry, compacted mass of refractory and binder particles, a wet compacted mass of refractory particles in which the binder is fluidized, and/or a hardened envelope of refractory body in which the binder is thermoset and binds refractory particles one to the other.

FIGS. 1 through 4 illustrate such a sequence during this prior technique of molding a refractory-binder mixture. The rectangular configuration of these figures represents a mold form 10 containing a mixture generally represented at 11 of particles of a refractory and particles of a thermosetting binder. Conventional fillers may also be present. As the mixture 11 is simultaneously heated and compacted, a central area 12 (FIG. 1) becomes compacted but the binder particles it contains remain substantially in a dry, solid state. However, an exterior portion of mixture 13 receives initially the effect of the heat applied, and the binder particles it contains are fluidized by the heat allowing further densification. As the compaction and heating continue, the volume of the dry, compacted center area 12 reduces in size (FIG. 2), while the volume of the mixture containing a fluidized binder 13 increases. The two areas are substantially concentric as illustrated. The continued application of heat begins to set or harden the thermosetting binder in an exterior outer area 14 which for the first time takes on the character of a molded refractory body, since the set binder adheres the refractory particles of area 14 one to the other.

Figure 3:
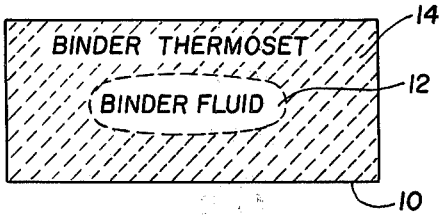

As this process continues, the central dry compaction area 12 disappears as the last of the binder particles fluidize, leaving a center area 12 of refractory particles containing fluidized binder (FIG. 3). Since thermoset area 14 is now relatively rigid, further compaction of the charge to the mold form can introduce cracking in area 14. At the same time, area 14 containing a hardened binder grows in size, and the resulting refractory body accommodates the balance of mold form 10. Finally, when all the binder particles have set (FIG. 4), the molding of a complete refractory body fills mold form 10. However, due to the sequential establishing and changing in size as well as changes in density due to compaction of areas 12, 13 and 14, a variety of relatively fine cracks and fractures 15 appear in the surfaces of the finely molded refractory body.

Figure 5:
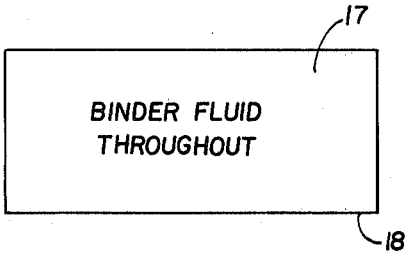
FIGS. 5 through 7 are diagramatic, schematic illustrations of sequential steps in the preparation of a refractory body by the present process.
Figure 2:
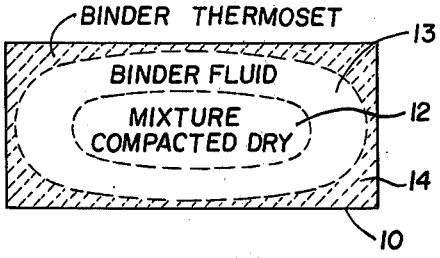
Figure 6:
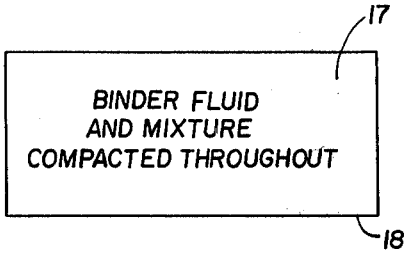
Figure 7:
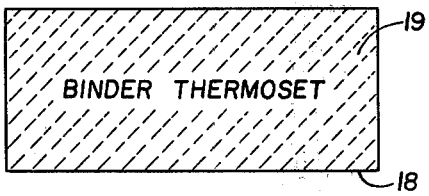
Figure 4:
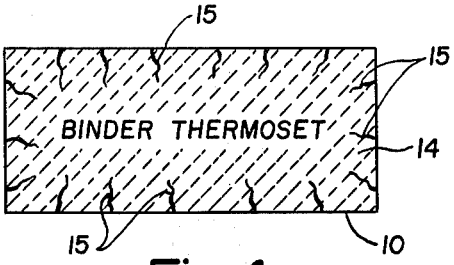

In contrast to this, FIGS. 5 through 7 illustrate the sequential steps of the present process. FIG. 5 illustrates that a mixture 17 of refractory and binder particles (either thermosetting or thermoplastic binder particles) when placed in a mold form 18 reaches a point in the process when all of the binder throughout the mold form is at one time fluidized and at a relatively uniform temperature. FIG. 6 illustrates that during subsequent compaction of mixture 17 there are no distinct and segregated areas differing in make-up as in the case of FIGS. 1 through 4. The binder is still fluid during compaction. Finally, as the compacted mixture of FIG. 6 is heated while maintaining the pressure of compaction, the fluidized binder of the entire mold is set (either by heating a thermosetting or cross-linking a cross-linkable binder, or cooling a thermoplastic one) to bind the refractory particles together and to provide a molded integral body having no surface cracks or fractures. FIG. 7 represents a molded integral body 19 in which the binder is thermosetting.

Referring more particularly to details of the present process, the refractory particles used may be of any known type suitable for the intended use of the ultimately molded refractory body. Examples include silica, zirconia, iron pyrites, fused or sintered bauxite, magnesia, and the like. For grinding wheels, more abrasive particles are used such as silicon carbide, alumina, and alumina-zirconia combinations. Average particle sizes for the refractory are not critical and may range from about 0.4 millimeter to about 2 millimeters in diameter depending on the end use of the molded refractory body.

One advantage of the present process is that both thermoplastic and thermosetting resinous binders may be used, although thermosetting binders are preferred. Relatively dry, solid particles of both types of resinous binders are preferably employed. Suitable thermoplastic resinous materials that can be used as a binder include: polyacrylic acid esters, polymethacrylic acid esters, polyvinyl butyral, nylon (polyamides), linear polyurethanes, linear polyesters, polysulfones, acrylonitrile butadiene styrene copolymers, and the like. Suitable thermosetting resinous materials that can be used as a binder include: phenol formaldehyde, urea formaldehyde, melamine formaldehyde, creosol formaldehyde, phenol furfural, epoxy resins, crosslinked polyester resins, crosslinked polyurethanes, polyimides and the like. Phenol formaldehyde and epoxy resins are preferred. Phenol formaldehyde novolak or resole resins can be catalyzed by any one of the following general catalysts: strong acids, weak acids, strong bases, weak bases, and metal salts and metal oxides, such as the acetates and oxides of zinc and magnesium.

The organic resinous binder is also preferably present in particle form whether thermoplastic or thermosetting. If thermosetting, the polymeric growth of the particles is such as to form a relatively dry solid capable of further cure or further polymerization to an infusible stage. In this regard, hexamethylenetetramine may be used as a source of formaldehyde in preparing the indicated formaldehyde resins. The formaldehyde reacts with the hydroxyl groups of the phenols to form methylene linkages. Hexamethylenetetramine is a colorless solid which has no odor and is thereby more readily handled than other forms of formaldehyde. Since this amine decomposes to formaldehyde only under the influence of heat, its reactions are more easily controlled.

The refractory particles and binder particles may be suitably admixed to form a uniform mixture by any standard means, such as a blender, tumbling, and the like. As a rule, only sufficient binder is used to bind well the refractory particles one to another to form an integral body. Less binder results in a weaker overall bond, while more binder results in waste of that ingredient. Since the binder will be fluidized subsequently in the process, its particle size is not at all critical, except that the smaller particle sizes facilitate a more thorough mix with the refractory particles. In general, particle binder sizes may range from about 1 micron to about 70 microns, and the binder is present in an amount of about 5% to about 25% by weight of the refractory particles.

After the refractory-binder particle mixture is prepared, it is preheated in the present process apart from a mold press. Any suitable container may hold the particle mixture, but preferably the container is a mold form having a cavity conforming to the shape of the body into which the fractory particles are to be formed. The container comprises material adapted to withstand the heat of the operation such as metal plates and rings or a suitably shaped die.

The container or mold form may be suitably preheated by any convenient means, such as an oven, direct exposure to burners, dielectric heating for magnetic particles, steam heating (especially for thermoplastic resinous binders), and the like. However, the preferred technique for preheating is by exposure to microwave energy, for this further decreases the cycle time of the overall process by quickly and uniformly reaching the desired temperature of preheat.

The microwave frequencies used are not critical and may range from about 900 MHz to about 25,000 MHz. However, microwave frequencies allocated by the Federal Communication Commission for industrial, scientific, and medical applications are 915 MHz; 2,450 MHz, 5,800 MHz and 22,125 MHz.

As indicated, the preheating of a mixture is primarily designed to save time in subsequent operations in a press and thereby increase the production rate of the press which is a relatively expensive piece of equipment. The preheating brings the mixture to within a desired temperature range which is between the melting or fusing point of the resinous binder and its decomposition or gelation temperature. In general, the preheating may be at a temperature within the range of about 90° C. to about 120° C.

The temperature of the preheating must be sufficient to fluidize the resinous binder. This heating time is thus unnecessary in the hot press. When fluidized, the binder flows throughout the refractory particle mass and wets the particles well to form a uniformly wet mixture or charge. A fluidization of the binder preferably occurs whether it is of the thermoplastic or thermosetting type. When the binder is thermoplastic, the preheating is short of thermally degrading the resin. A thermoplastic resin used as a binder must have a fusion temperature well above the expected temperatures that are present or generated when the ultimately molded refractory body is in use. If the temperature of use is at or near room temperatures, thermoplastic resinous binders can be used for the purpose indicated. When the binder is thermosetting, the preheating converts the binder particles to a fluid that is short of appreciable further curing the resin. During this stage of the process, there is no compacting pressure on the refractory particles-binder mixture at all. FIG. 5 represents this stage of the process.

After preheating, the mixture along with its container or mold form is transferred to a press, such as between the platens of the hot mold press. Several of such preheated mixtures may be prepared as separate units and then inserted en mass in the press mold as a further means of increasing the output of the press. While in the press, the refractory particle-binder mixture is subjected to compaction for the first time. It is emphasized that the binder has already been fluidized and well mixed with the refractory particles at this stage. Preferably the compaction is at substantially the preheating temperature in which the press mold may supply the heat needed. Compaction is continued until a desired density of refractory particles is obtained which is substantially equal to the density desired in the ultimately molded refractory body. As an example, the maximum density obtained by compaction may be within the range of about 2.0 to about 4.0 grams per cubic centimeter, although values outside of this range are not unusual. FIG. 6 represents this stage of the process.

Rapid densification occurs during compaction. When compaction of the refractory-binder mixture reaches a desired density, the binder is converted to a solid state to bind the refractory particles into an integral body while still maintaining the compaction pressure. FIG. 7 represents this stage of the process. If the binder is thermoplastic, conversion to a solid state is by cooling the binder to a hardened form. If the binder is thermosetting, conversion is by heat, such as heat of the mold, which converts the binder to a hard, infusible, irreversible state. In either case, the compaction is released only after conversion of the binder to a solid state. The molded refractory body is removed from the container or mold form and, in the instance of a thermosetting binder, the body may be subjected to a post cure heating step. The cure temperatures of the thermosetting resins indicated as useful are well known in the art.

WORKING EXAMPLE

A mixture was prepared by tumbling together silicon carbide particles having an average particle size of 30 to 80 mesh, U.S. Standard sieve and dry binder particles of partially cured phenol formaldehyde having an average particle size of minus 200 mesh. The binder particles comprised about 8% by weight of the silicon carbide particles. It will be understood that in this and other examples herein referred to, standard fillers and other known additives conventionally used in molding refractory particles can be included if desired. Such fillers, additives, etc., usually comprise about 5% to about 20% and preferably about 10% by weight of the entire mixture. For example, suitable fillers include CaO, $CaO.SiO_2$, $FeS_2$, $BaSO_4$, $CaSO_4$, $KBF_4$, $Na_3AlF_6$, elemental sulfur, polyvinylidene chloride, various fibers, such as glass, carbon, resinous polymeric, wood, and fabric fibers, and the like.

Four different molds for a grinding wheel were filled with the mixture at room temperature. Each mold comprised two concentric circular metal bands defining an anular area between them. Two flat plates closely fitted in the anular area, one being relatively thin and forming a bottom plate, and the other being relatively thick and forming a top plate designed to fit relatively tightly between the two bands but still free to pass between them toward the bottom plate for purposes of compaction. The top plate can be added before or after preheating, but if the preheating is by microwave energy, the top plate is preferably added after preheating. In either case, the top plate has a sufficient thickness to at least reach the top edge of the metal bands when resting on the refractory-binder mix, even at the moment of maximum compaction of the mixture.

After all four molds were filled with the refractory particle-binder mixture, they were subjected to a microwave unit emitting energy at about 2450 MHz for about 3 minutes to about 5 minutes. This heated the molds and their charges to a temperature to within the range of about 90° C. to about 120° C. Then all four molds were transferred between the platens of a hot mold press and the platens moved relatively toward each other. The top platen of the mold engaged the top plate of each mold form and forced it between the concentric metal bands to compress the mixture therein. The platens of the press mold were steam heated, and this maintained the temperature of the mixture at substantially the temperature of preheating.

Compaction applied through the top plate continued until a density of about 2.5 to about 3.6 grams per cubic centimeter was reached in the pressurization of the refractory particle-binder mixture, the binder still being fluid at this point in the process. Then, while maintaining substantially the same pressure on the mixture, the temperature of the press mold was increased to cure the phenol-formaldehyde resin at about 163° C. and bind the silicon carbide particles one to another and form an integral body from each charge of a mold form. After the refractory bodies were removed from the mold forms, it was noted there were no cracks or fractures on the surfaces of any of the molded bodies and the binders in each had a homogeneity of cure. The molded bodies were subjected to a post cure heating step in accordance with conventional procedures. Segments of a grinding wheel could have been molded in the same manner.

Although the foregoing describes several embodiments of the present invention, it is understood that the invention may be practiced in still other forms within the scope of the following claims.

I claim:

1. A process for molding a refractory body of improved strength and prolonged useful life with a mold press while simultaneously increasing the production rate of said press, said process comprising placing in a mold form a mixture of refractory particles and an organic resinous binder that is present in sufficient amount to bind said particles one to another, subjecting the mixture and mold form to microwave energy in the absence of pressure on the mixture to preheat the mixture to a temperature at which the resinous binder is fluid, then transferring the preheated mold form and mixture to a press, compacting the mixture in said mold form to a predetermined, desired density substantially equal to the density of the ultimately molded body while maintaining the resinous binder in a fluid state, and then converting the resinous binder to a solid state effective to bind the particles one to another in said mold form while still maintaining said pressure on the mixture.

2. The process of claim 1 in which said body is a grinding wheel.

3. A process for molding an abrasive body of improved strength and prolonged useful life with a mold press while simultaneously increasing the production rate of said press, comprising:

(a) forming a plurality of charges, each charge comprising a mixture of abrasive particles and a curable thermosetting resinous binder that is present in sufficient amount to bind the abrasive particles of each charge one to another, (b) subjecting each charge in the absence of pressure thereon to microwave energy to preheat each charge to a temperature within the range of about 90° C. to about 120° C. and maintain said binder in a fluid state, (c) transferring a number of said preheated charges to the same mold press and compacting the mixture of each charge by the press to a predetermined, desired density substantially equal to the density desired in the ultimately molded abrasive body while maintaining the curable, thermosetting resin in said fluid state, and (d) then, while still maintaining said compacting pressure on each charge, heating each charge in said press to cure the thermosetting resinous binder of each charge to a solid state and bind the abrasive particles one to another.

4. The process of claim 1 in which said microwave energy is within the range of about 900 MHz to about 25,000 MHz.

5. The process of claim 1 in which said refractory particles are abrasive particles selected from the group consisting of silicon carbide, silica, alumina, iron pyrites, zirconia, magnesia, and combinations thereof.

6. The process of claim 1 in which said organic resinous binder is thermosetting, and said step of converting the binder to a solid state comprises heating the resinous binder to an infusible state.

7. The process of claim 1 in which said organic resinous binder is thermoplastic, and said step of converting the binder to a solid state comprises cooling the resinous binder to a hardened form.

8. The process of claim 1 in which said resinous binder is present in an amount of about 5% to about 25% by weight of said refractory particles.

9. The process of claim 1 in which said mixture is preheated to a temperature between the melting point of the binder and its decomposition temperature.

10. The process of claim 1 in which said resinous binder is phenol formaldehyde.

11. The process of claim 1 in which said compaction of the mixture is substantially at said preheating temperature.

12. The process of claim 1 in which said density obtained by the compaction is within the range of about 2.0 to about 4.0 grams per cubic centimeter.

13. The process of claim 1 in which said resinous binder is thermosetting and said molded integral body is subjected to a post cure heating step.

14. The process of claim 1 in which said preheating temperature is within the range of about 90° C. to about 120° C.

* * * * *